US009247785B1

(12) United States Patent
Kacines

(10) Patent No.: US 9,247,785 B1
(45) Date of Patent: Feb. 2, 2016

(54) ITEM WITH ADJUSTABLE HANGER LOOP

(71) Applicant: Jeffery J. Kacines, Allen, TX (US)

(72) Inventor: Jeffery J. Kacines, Allen, TX (US)

( * ) Notice: Subject to any disclaimer, the term of this patent is extended or adjusted under 35 U.S.C. 154(b) by 340 days.

(21) Appl. No.: 13/648,608

(22) Filed: Oct. 10, 2012

Related U.S. Application Data

(60) Provisional application No. 61/628,707, filed on Nov. 4, 2011.

(51) Int. Cl.
*A44B 1/24* (2006.01)

(52) U.S. Cl.
CPC ..... *A44B 1/24* (2013.01)

(58) Field of Classification Search
CPC ..... A44B 1/00; A44B 1/18; A44B 1/185; A41F 11/04; A41F 13/00
USPC ..... 24/716, 114.8, 660, 104, 113 R
See application file for complete search history.

(56) References Cited

U.S. PATENT DOCUMENTS

| | | | | | |
|---|---|---|---|---|---|
| 234,684 | A | * | 11/1880 | Milliken | 24/114.8 |
| 275,975 | A | * | 4/1883 | Atwood | 24/320 |
| 294,074 | A | * | 2/1884 | Price et al. | 24/660 |
| 440,371 | A | * | 11/1890 | Schloss | 24/114.8 |
| 450,510 | A | * | 4/1891 | Heuser | 24/114.8 |
| 483,672 | A | * | 10/1892 | Green | 24/378.1 |
| 502,962 | A | * | 8/1893 | Green | 24/660 |
| 617,074 | A | * | 1/1899 | Blumenthal | 24/660 |
| 716,198 | A | * | 12/1902 | Davis | 2/230 |
| 1,081,096 | A | * | 12/1913 | Commerford et al. | 24/90.1 |
| 1,437,123 | A | * | 11/1922 | Wiechmann | A41B 11/12 2/240 |
| 1,892,610 | A | * | 12/1932 | Dawes | 24/660 |
| 1,913,934 | A | * | 6/1933 | La Mont | 24/478 |
| 2,608,691 | A | * | 9/1952 | Berg | 2/325 |
| 2,615,170 | A | * | 10/1952 | Mintz | A41B 11/01 2/240 |
| 2,647,265 | A | * | 8/1953 | Levenson | 2/303 |
| 2,845,670 | A | * | 8/1958 | Brown et al. | 24/16 R |
| 2,899,731 | A | * | 8/1959 | Maxim | 24/660 |
| 2,952,315 | A | * | 9/1960 | Brontman | 160/330 |
| 2,983,006 | A | * | 5/1961 | Schafer | 24/378.1 |
| 3,099,271 | A | * | 7/1963 | Dubelier | 132/273 |
| 3,522,635 | A | * | 8/1970 | Nilsson | 24/369 |
| 4,043,006 | A | * | 8/1977 | Williams et al. | 24/114.8 |
| 4,083,233 | A | * | 4/1978 | Seal | 73/828 |
| RE30,701 | E | * | 8/1981 | Williams et al. | 24/114.8 |
| 4,582,109 | A | * | 4/1986 | Fairbanks | 160/84.04 |
| 5,389,028 | A | * | 2/1995 | Cabrera et al. | 446/73 |
| 5,523,741 | A | | 6/1996 | Cane | |
| 5,715,578 | A | * | 2/1998 | Knudson | 24/16 PB |
| 5,738,159 | A | * | 4/1998 | O'Brien | 160/84.01 |
| 6,389,659 | B1 | * | 5/2002 | Jacobs | 24/573.09 |
| 6,543,094 | B2 | * | 4/2003 | D'Addario | 24/16 PB |
| 6,789,600 | B2 | * | 9/2004 | O'Neill Kuchinsky | 160/348 |
| 7,334,764 | B2 | * | 2/2008 | Robert | 248/231.9 |
| 7,784,157 | B1 | * | 8/2010 | Short, deceased et al. | 24/3.13 |
| 8,850,667 | B2 | * | 10/2014 | Casubolo | 24/114.8 |
| 2005/0103732 | A1 | * | 5/2005 | Waszak et al. | 211/90.01 |
| 2011/0031369 | A1 | * | 2/2011 | Kacines | 248/344 |
| 2012/0192383 | A1 | * | 8/2012 | Casubolo | 24/114.7 |

* cited by examiner

*Primary Examiner* — Robert J Sandy
*Assistant Examiner* — Rowland Do
(74) *Attorney, Agent, or Firm* — Roger N. Chauza, PC

(57) ABSTRACT

A flexible hanger loop adjustably attached to an item for causing the item to be suspended with a desired orientation when hung from a hanger by the flexible loop. The item is constructed with a hole therein through which a portion of the flexible loop extends. An enlarged end of the loop prevents it from being inadvertently pulled back through the hole. In order to adjust the orientation of the item when hung by the loop from a hanger, the portion of the loop extending through the hole is twisted or rotated, whereby the item assumes a new natural orientation.

20 Claims, 3 Drawing Sheets

ITEM WITH ADJUSTABLE HANGER LOOP

RELATED APPLICATION

This non-provisional patent application claims the benefit of U.S. Provisional Application Ser. No. 61/628,707, filed Nov. 4, 2011.

TECHNICAL FIELD OF THE INVENTION

The present invention relates in general to ornament hangers, and more particularly to plush ornaments having hanger loops that maintain the ornaments in desired orientations.

BACKGROUND OF THE INVENTION

In order to decorate a person's home, office or place of business, it is often desirable to hang ornaments and items that are important to the person, or that relate to a holiday, birthday or other event. The ornaments can be of various types including Christmas ornaments hung from a mantel, ledge, door or tree, or plush toys or stockings, also hung from a mantel or the like. Some ornaments are constructed with writings or pictures on them that relate to the season or event. When hung for display, it is desirable that the ornament be oriented so that the information can be read or seen by the observer. With many rigid ornaments, the hanger is constructed so that the orientation of the ornament can be manipulated so that it remains in a desired orientation so that the information located thereon can be easily seen, and not hidden behind the ornament. Other ornaments, such as plush or soft items, such as Christmas stockings, are constructed with a flexible material loop sewn to the stocking, and thus the orientation of the stocking cannot be adjusted so as to be suspended from a hanger in a desired orientation. Sometimes the material loop can be twisted somewhat to achieve a desired orientation, but this is by happenstance and is not predictable.

From the foregoing, it can be seen that a need exists for a technique to attach a loop to an item so that the loop can be easily adjusted to achieve a desired orientation. A further need exists for a loop type hanger mechanism and technique that can be adjusted in countless different angles to achieve any orientation of the item that is suspended from a hook, or the like. Another need exists for an adjustable hanger that is cost effective and easily integrated into the manufacture of many different ornamental items.

SUMMARY OF THE INVENTION

In accordance with the principles and concepts of the invention, there is disclosed a technique for fastening a loop to an ornamental item where the loop can be rotated or twisted in any orientation so that the ornament will maintain a desired orientation when hung from a hanger.

In accordance with one embodiment of the invention, disclosed is a Christmas stocking having a flexible material loop that is terminated with an enlarged end, such as with a conventional button. The stocking has a button hole therein at the top edge, and the button of the loop is inserted through the button hole. The material loop can then be twisted in any orientation with respect to the stocking so that the stocking hangs in the desired orientation when the adjustable loop is hung from a hanger, or the like.

In accordance with another feature of the invention, the loop by which the ornamental item is hung can have a wire inserted therein, where the wire extends into the object. Thus, the loop with the wire therein can be twisted sufficiently to provide a desired stable orientation to the object when hung by the loop.

In accordance with one embodiment of the invention, disclosed is a loop for hanging an item of the type having a hole therein so that the item can be hung with a desired orientation. The loop is constructed of a flexible material, and has an enlarged end. The enlarged end of the loop is adapted for insertion into the hole of the item so that at least a portion of the loop adjacent the enlarged end can be twisted in the hole of the item to adjustably orient the loop with respect to the item.

In accordance with another embodiment of the invention, disclosed is a loop for hanging a Christmas stocking with a desired orientation, where the Christmas stocking has a stocking-shaped body and an open top. A hole is formed in a top portion of the Christmas stocking. A loop is constructed of a flexible material having an enlarged end that can be inserted through the hole of the Christmas stocking. A portion of the flexible loop adjacent the enlarged end can be twisted in the hole of the stocking to thereby adjust the orientation of the loop with respect to the stocking.

According to yet another embodiment, disclosed is a method of adjusting an orientation of an item hung from a hanger. The method includes hanging the item on a hanger hook from a flexible loop and observing the natural orientation of the item. If the orientation of the hung item is other than desired, the flexible loop is twisted at a location where it passes through a hole in the item to thereby rotate that portion of the loop passing through the hole. The new natural orientation of the item is then observed when hung from the hanger.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
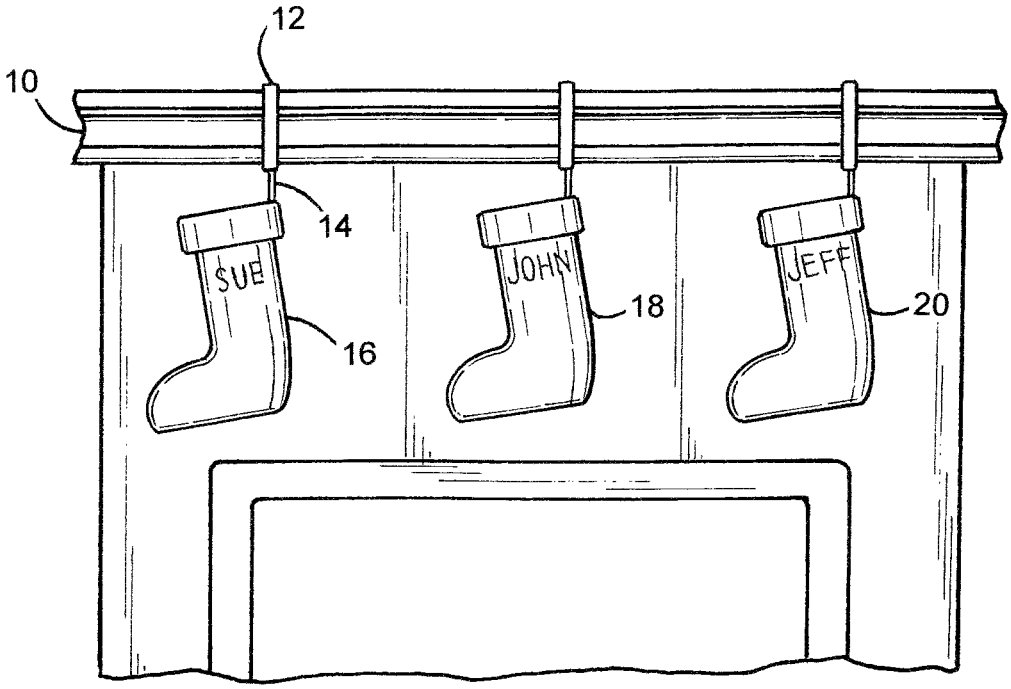
FIG. 1 is a frontal view of a mantel from which three Christmas stockings are hung and oriented so that the names on the stockings all face in the same direction.

With reference to FIG. 1, there is illustrated an environment in which the principles and concepts of the invention can be practiced. Christmas stockings are often hung from a fireplace mantel 10 by hangers 12 having an upper portion which overlie at least a portion of the top surface of the mantel 10.

The bottom portion of the hangers 12 have a hook from which the flexible loop 14 of the Christmas stocking 16 is suspended. Many different types of hangers can be utilized by those skilled in the art. Indeed, the adjustable loops 14 of the ornaments can be suspended from the limbs of a Christmas tree itself, from a hanger suspended from a chair, ledge, wall or top of a door, etc. In the illustration, each stocking 16, 18 and 20 has a person's name imprinted thereon so as to identify which stocking belongs to which person. In this instance, it is desirable and more decorative to have the stockings 16, 18 and 20 all oriented in the same manner to easily see the names. In addition, the orderly hanging of the stockings 16, 18 and 20 provides a more pleasing appearance. It can be appreciated that without some mechanism to individually orient each stocking 16, 18 and 20, they would in all likelihood be oriented in a random manner and not in an ordered manner in which the names can all be easily seen.

Figure 2:
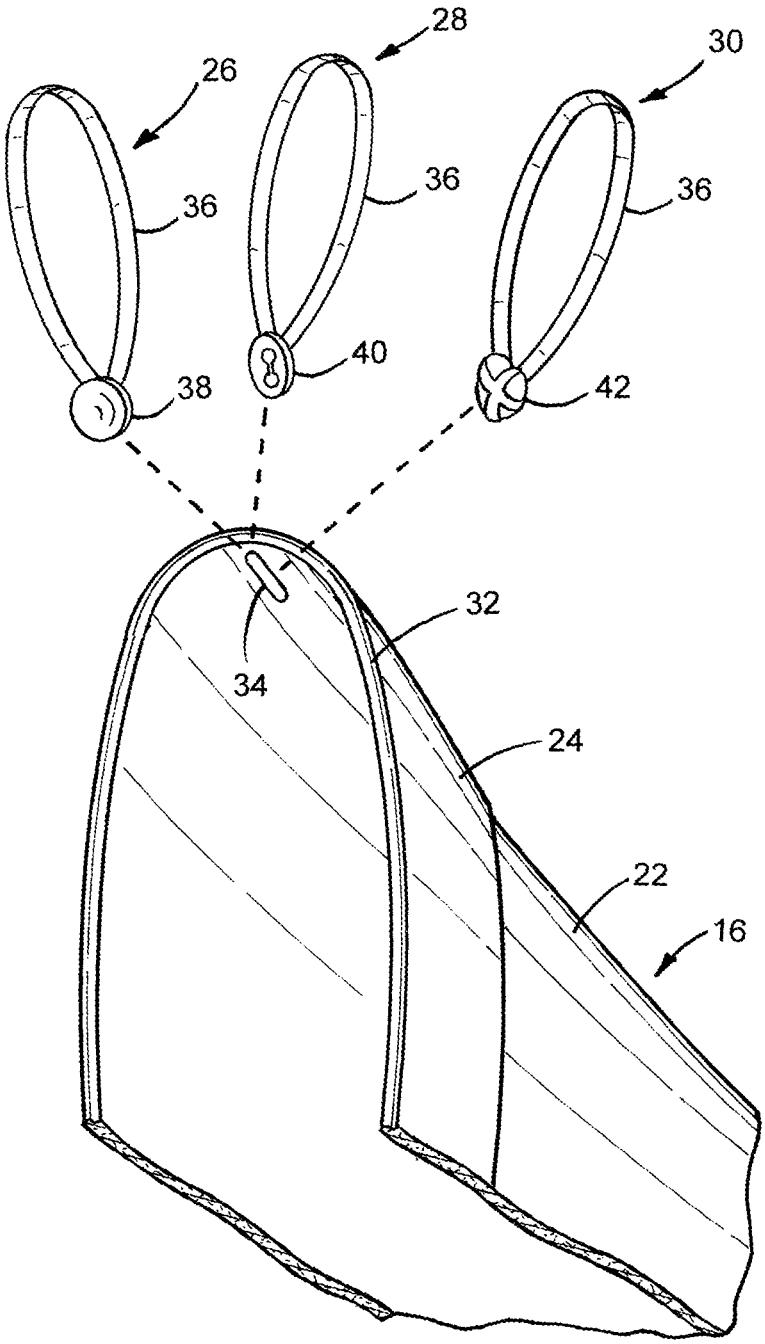
FIG. 2 is an isometric view of a top portion of a Christmas stocking and the manner in which the adjustable loop is fastened thereto.

With reference to FIG. 2, there is illustrated one embodiment of an ornamental Christmas stocking 16, operable with any one of three different adjustable loops 26, 28 and 30. The Christmas stocking 16 can be of many different constructions, but generally will have a plush red material body 22, and a white soft fluffy or furry cuff 24 around the outer surface of the top opening of the stocking 16. The white fluffy cuff 24 can be sewn to the upper edge of the stocking body 22 at the seam 32. Of course, the seam 32 can be of the type where the stitching is preferably hidden.

A slit or button hole 34 is formed in the upper back surface of the stocking 16. Preferably, there are at least two layers of material at the button hole location so that the slot 34 is only formed in the inner layer of material, such as in the material forming the body 22 of the stocking 16. With two layers of material at the button hole location, the enlarged end of the loop is not visible from outside of the stocking 16. While the button hole 34 is shown vertically oriented, which is preferable, other orientations of the button hole 34 are possible. Depending on the type of enlarged end attached to the loop, the hole formed in the stocking 16 can be different shapes and need not be a slot. It is preferable that the button hole be formed vertical to allow stocking 16 to be loaded with toys or gifts without the adjustable loop 26, 28 or 30 becoming disconnected from the stocking. The perimeter of the button hole 34 can be stitched to make it stiffer, more durable and longer lasting.

The adjustable hanger loops 26, 28 and 30 are all constructed with respective loops 36 which can be of the same material as the body 22 of the stocking 16, i.e. a red plush material. The loop 36 is generally tubular in cross section, with the plush material on the entire outside surface of the loop 36. The red plush material can be sewn or bonded at the elongate seam to form a tubular member that is then arranged in a loop, as shown. A portion of the loop 36 is then fastened to or otherwise formed with an enlarged end. The hanger loop 26 has an end fastened to a ball 38 or other bulb-type member. The hanger loop 28 is fastened to a button 40, and the hanger loop 30 is tied in a knot 42 at the end thereof. Those skilled in the art may find that there are many other things that can be fastening to the end of the loops 36 to form enlarged ends.

The enlarged ball 38 of the hanger loop 26 can be inserted into the button hole 34 of the stocking 16 so that the stocking 16 can be hung by way of the loop 36. The enlarged button 40 of the hanger loop 28 can be inserted into the button hole 34 of the stocking 16 so that the stocking 16 can be hung by way of the loop 36. Similarly, the enlarged knot 42 of the loop 30 can be inserted into the button hole 34 of the stocking 16 so that the stocking 16 can be hung by way of the loop 36.

Figure 3:
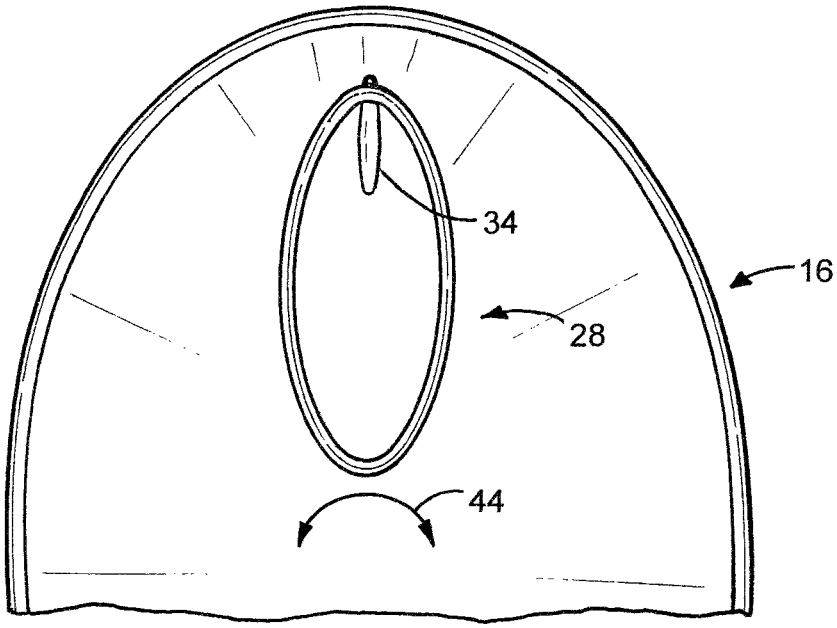
FIG. 3 is an isometric view of a Christmas stocking in which the loop is shown being twisted to provide adjustment to the orientation of the stocking.

FIG. 3 illustrates the manner in which the hanger loop 28 can be adjusted within the stocking 16. Once the enlarged end 40 is inserted through the button hole 34, the stocking is hung from the hanger 12 to see what the natural orientation of the stocking 16 tends to be. If the orientation is other than a desired orientation, then the stocking 16 can be removed from the hanger 12 and the hanger loop 28 twisted in one direction or the opposite in the button hole 34. The twisting is shown by arrow 44. The hanger loop 28 can be grasped adjacent the location where it enters the button hole 34 and twisted in one direction or the other to rotate the portion of the hanger loop 28 that extends through the button hole 34. The stocking 16 is then hung again by the hanger loop 28 to observe the new orientation. By trial and error, the hanger loop 28 can be twisted the correct amount and in the correct direction to achieve the desired orientation when hung from the hanger 12. Alternatively, the stocking 16 can remain hung and the hanger loop 28 manually twisted to achieve the correct orientation. Once the hanger loop 28 is twisted in the button hole 34 to obtain a desired orientation, the hanger loop 28 remains in that orientation due to the friction between the button hole 34 and that part of the loop extending through the button hole 34. Additional friction is exerted between the enlarged end 40 and the inside surface of material in which the button hole 34 is formed. As such, the Christmas stocking 16 may rotate or oscillate immediately after being hung, but will settle to a natural position. During this transition to find the natural position of the stocking 16, the rotational motion of the stocking 16 will not overcome the friction between the hanger loop 28 and the button hole 34 to thereby cause the initial position of the loop set by the user to change.

Figure 4A:
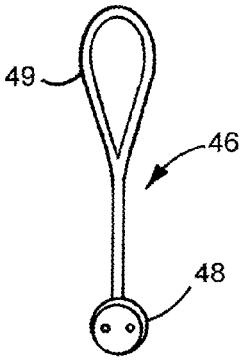
FIG. 4*a* illustrates another embodiment of an adjustable closed loop.

As illustrated in FIG. 4*a*, the hanger loop 46 can be a single strand of material at one end connected to the enlarged object, such as a button 48 in the example. A closed hanger loop 49 is formed at the other end. The end of the single strand of material can be sewn or otherwise fastened or bonded to the button 48. While this is effective to provide the advantages of the invention, it is believed that the embodiments of the loops 26, 28 and 30 shown in FIG. 2 offer additional advantages. In each embodiment of FIG. 2, there are two ends of the loop fastened to the enlarged end, and the two ends of the loop 36 extend through the button hole 34. Thus, with two pieces of the loop 36 forming a non-symmetrical member extending through the button hole 34, there is less chance that the loop 36 will inadvertently twist in the button hole 34 and change positions.

Figure 4B:
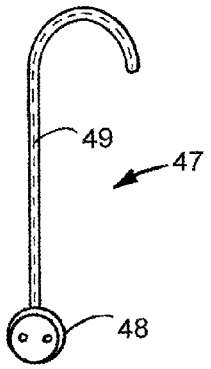
FIG. 4*b* illustrates yet another embodiment of an adjustable open loop.

FIG. 4*b* illustrates another embodiment of an adjustable hanger loop or hook 47. In this embodiment, the adjustable hanger loop 47 is open, rather than being closed as illustrated in FIG. 4*a*. The adjustable open hanger loop 47 is constructed of a tubular material through which a wire 49 is threaded. The flexible tubular material of hanger loop 47 can be of a decorative type that matches the item to be hung from a hanger 12. The decorative tubular material can be twisted together with the wire 49 therein so that the item attached to the open hanger loop 47 is suspended at a desired orientation. Much like that described above, the wire 49 as well as the flexible material can be fastened to an enlarged end, such as a button 48.

Figure 5:
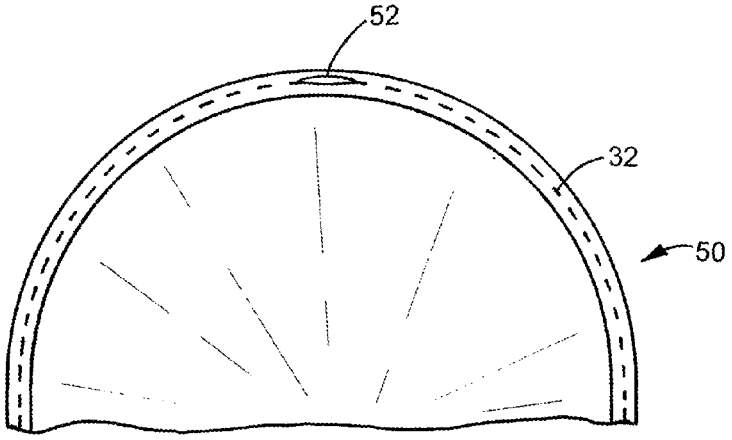
FIG. 5 is a top view of another embodiment of a portion of a Christmas stocking illustrating the button hole located on the top edge of the stocking.

FIG. 5 illustrates another embodiment of a top portion of a Christmas stocking 50 in which the button hole 52 is formed in the top edge of the stocking 50. Here, rather than forming the button hole in the inside layer of material of the body of the stocking 50, as shown in FIG. 2, the button hole 52 is formed in the top annular edge of the stocking 50. Again, a short portion of the loop 36 and the enlarged end can be pushed through the button hole 52 to adjustably fasten the hanger loop to the Christmas stocking 50. The Christmas stocking 50 can then be hung by the hanger loop via the enlarged end thereof and the button hole 52.

Those skilled in the art may find that the button hole can be formed in the ornament in many other locations. For example, the button hole can be formed in the outer layer of the stocking, near the top annular open end. Moreover, the button hole can be located on the top side of the stocking so that the opposite side of the stocking is presented to the observer. In yet other instances, the stocking can be constructed with multiple button holes located in different positions on the stocking so that the user can choose where to insert the enlarged end of the loop. The loop itself can be constructed of materials other than the same material of the hanging ornament. For example, the loop can be constructed of a plastic or other synthetic material film. Lastly, and as noted above, the button hole can be shapes other than slits.

Figure 6:
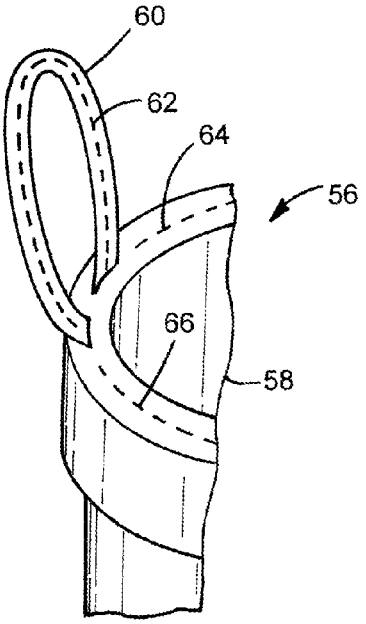
FIG. 6 illustrates another embodiment of an adjustable loop in which a wire is inserted in the tubular loop itself and extends into the stocking.

FIG. 6 illustrates another embodiment of an adjustable hanger loop 60 fastened to the top portion of a hanging ornament, such as a Christmas stocking 58. Here, there is constructed a tubular hanger loop 60 of material that extends to the top annular surface of the stocking 58. The two ends of the tubular hanger loop 60 can be fastened together to the top annular edge of the stocking 58. Inserted inside the tubular hanger loop 60 is a metal wire 62. The wire 62 can be of any conventional type that remains twisted until untwisted, or twisted more to change its shape. The wire 62 extends all around the tubular hanger loop 60, with the ends 64 and 66 of the wire 62 extending inside the top annular edge of the stocking 58. The top annular edge of the stocking 58 can be sewn with a seam parallel to the top annular edge of the stocking 58 to form an annular channel in which the ends 64 and 66 of the wire 62 are routed. The portion of the hanger loop 60 that extends from the top of the stocking 58 can be twisted to adjust the hanger loop 60 in different orientations with respect to the stocking 58. With this arrangement, the hanger loop 60 can be adjusted by twisting the looped material and the wire 62 to effectively rotate the hanger loop 60 with respect to the stocking 58 to achieve a desired orientation of the stocking 58 with respect to the hanger 12 from which it is hung.

From the foregoing, disclosed are various techniques for constructing hanging ornaments, items and objects where the position of the suspended ornament, item or object is important. The hanger loop by which the item is hung can be adjusted with respect to the item so that the natural hanging position of the item is a desired position. It should be understood that while the principles and concepts of the invention have been described in connection with a Christmas stocking, many other ornaments, items and objects can be the subject matter of the invention. For example, many ornaments can be hung to celebrate many holidays or events, and many items can be hung for display, sale or other reasons.

While the preferred and other embodiments of the invention have been disclosed with reference to specific ornament hanger loops and hanger apparatus, and associated methods of construction and use thereof, it is to be understood that many changes in detail may be made as a matter of engineering choices without departing from the spirit and scope of the invention, as defined by the appended claims.

What is claimed is:

1. A hanger loop and an item of the type having a sidewall with a buttonhole slot therein from which said item is suspended by said hanger loop so that said item hangs freely downwardly by gravity from said buttonhole slot and is free to rotate to a natural orientation, comprising:

a twistable hanger with a loop at a first end thereof, said loop for hanging the item from a hook via said twistable hanger;

said twistable hanger having at a second end a twistable end attached to an enlarged member, said twistable hanger being twisted by rotating the twistable hanger around an axis extending through said enlarged member and through said buttonhole slot, said enlarged member is capable of being inserted through said buttonhole slot and located adjacent a surface of said sidewall surrounding said buttonhole slot, and said enlarged member engaged with the surface surrounding said buttonhole slot so as to fasten said twistable hanger to the sidewall of said item;

said twistable end of said loop extending through the buttonhole slot in the sidewall of the item so that at least a portion of the twistable hanger is twisted in the buttonhole slot, and remains twisted to adjustably orient the item annularly about a vertical axis as the item hangs via the twistable hanger and loop.

2. The hanger loop of claim 1, wherein said enlarged member comprises a button sewn to the twistable end of said twistable hanger.

3. The hanger loop of claim 1, wherein said enlarged member comprises a knot formed by knotting an end of the twistable hanger.

4. The hanger loop of claim 1, wherein said enlarged member comprises a bulb attached to an end of said twistable hanger.

5. The hanger loop of claim 1, wherein said item is constructed with a soft and plush fabric covering, and the twistable hanger is constructed of the same type of soft and plush fabric covering.

6. The hanger loop of claim 5, wherein said item comprises in combination a Christmas stocking.

7. The hanger loop of claim 6, wherein said Christmas stocking is constructed with two layers of material defined by an inside layer of material and an outside layer of material, and wherein the button hole slot is formed vertically in only the inside layer of a material of the Christmas stocking.

8. The hanger loop of claim 7, wherein the enlarged member of said twistable hanger is located between said inside layer and said outside layer and is thus hidden from view.

9. The hanger loop of claim 1, wherein said twistable hanger includes two strands which are attached to said enlarged member, wherein said two strands extend through said buttonhole slot from the enlarged member and connected together in said loop.

10. The hanger loop of claim 1, wherein said twistable hanger comprises only a single strand of material that is not looped and extends through said buttonhole slot.

11. The hanger loop of claim 1, wherein said loop comprises an open hook end.

12. The hanger loop of claim 1, wherein said loop comprises a closed end.

13. The hanger loop of claim 1, wherein said loop includes a loop of wire inserted therein, where the loop of wire can be twisted so that the loop and wire therein is maintained at a predetermined orientation with respect to the item.

14. A loop for hanging a Christmas stocking with a desired orientation, comprising:

a Christmas stocking having a stocking shape body and an open top, said Christmas stocking constructed with a first and a second layer of material parallel and in contact with each other;

a hole formed in one said layer of material at a top portion of said Christmas stocking;

a hanging loop mechanism which includes a flexible loop and an enlarged end, said hanging loop mechanism extending through the hole of the Christmas stocking so that a weight of said Christmas stocking is exerted on said hanging loop mechanism, a portion of the hanging loop mechanism extending through said hole exhibiting friction with the hole due to the weight of said Christmas stocking, whereby a portion of the hanging loop mechanism adjacent the enlarged end can be rotated in the hole of the stocking, and the friction therebetween maintains the hanging loop mechanism in a different position with respect to the Christmas stocking to thereby adjust and maintain a new orientation of the loop with respect to said stocking; and said enlarged end of said flexible loop inserted through said hole so as to be located between said first and second layers of material, said enlarged end is thus not visible to a user of said Christmas stocking.

15. The loop of claim 14, wherein said hole comprises a buttonhole slot, and said enlarged end comprises a button, and said button is capable of being inserted through said buttonhole slot and engaged therewith to fasten said hanger loop mechanism to said Christmas stocking.

16. The Christmas stocking of claim 14, wherein said flexible loop is constructed with the same material as said body of said Christmas stocking and is flexible but not stretchable.

17. The Christmas stocking of claim 14, wherein said hole is formed only in said first layer of material and not in said second layer of material, whereby said enlarged end is hidden from view.

18. A method of adjusting an orientation of a Christmas stocking about a vertical axis when dangling downwardly by gravity from a hanger loop according to claim 1, comprising:

hanging the Christmas stocking on a hanger by the twistable loop attached to said Christmas stocking and allowing the Christmas stocking to rotate about the vertical axis and reach a natural orientation;

if the natural orientation of the dangling Christmas stocking about the vertical axis is other than desired, twisting the twistable loop at a location where it passes through a hole in the Christmas stocking;

allowing friction between the hole in the Christmas stocking and the twisted twistable loop to maintain the Christmas stocking in a new natural orientation about the vertical axis; and observing the new natural orientation of the Christmas stocking dangling from the hanger.

19. The method of claim 18, further including twisting the loop where it passes through the hole in the Christmas stocking in a clockwise direction to cause the Christmas stocking to rotate in one direction to find a first natural orientation, and twisting the loop where it passes through the hole in the Christmas stocking in a counterclockwise direction to cause the Christmas stocking to rotate in an opposite direction to find a second natural orientation different from the first natural direction.

20. The method of claim 18, further including using an enlarged end of the twistable loop that is capable of being inserted through the hole and engaged therewith to prevent the twisted loop from untwisting.

* * * * *